US007344224B2

(12) United States Patent
Ishii et al.

(10) Patent No.: US 7,344,224 B2
(45) Date of Patent: Mar. 18, 2008

(54) CARRIAGE CAPABLE OF SHIELDING VIBRATION TRANSMISSION AND RECORDING APPARATUS AND LIQUID EJECTION APPARATUS INCLUDING THE CARRIAGE

(75) Inventors: Takayuki Ishii, Nagano-ken (JP); Kazumi Kamoi, Nagano-ken (JP); Tsuyoshi Otani, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 374 days.

(21) Appl. No.: 11/043,424

(22) Filed: Jan. 27, 2005

(65) Prior Publication Data

US 2005/0206676 A1 Sep. 22, 2005

(30) Foreign Application Priority Data

| | | |
|---|---|---|
| Jan. 27, 2004 | (JP) | P2004-018805 |
| Jan. 27, 2004 | (JP) | P2004-018806 |
| Sep. 13, 2004 | (JP) | P2004-264923 |
| Sep. 13, 2004 | (JP) | P2004-264924 |
| Sep. 14, 2004 | (JP) | P2004-267492 |

(51) Int. Cl.
*B41J 23/00* (2006.01)

(52) U.S. Cl. ..... 347/37; 347/108

(58) Field of Classification Search ..... 347/37, 347/108, 109, 14, 19
See application file for complete search history.

(56) References Cited

U.S. PATENT DOCUMENTS 5,946,010 A * 8/1999 Isobe et al. ..... 347/37
6,695,436 B2 * 2/2004 Jang et al. ..... 347/49

FOREIGN PATENT DOCUMENTS

JP 10-337924 A 12/1998

* cited by examiner

*Primary Examiner*—Manish S. Shah
(74) *Attorney, Agent, or Firm*—Sughrue Mion, PLLC

(57) ABSTRACT

A carriage, on which a recording head is mounted, and to which a moving unit is connected, reciprocates a recording area by the moving unit to perform recording by the recording head. In the carriage, a recording head mount part and a connection part to the moving unit are separately provided, and the mount part and the connection part are coupled by a coupling structure having a linear elastic member. Hereby, vibration from the moving unit is shielded in the division portion and is not transmitted to the recording head mount part. Therefore, recording accuracy of the recording head can be kept in a high state.

12 Claims, 13 Drawing Sheets

CARRIAGE CAPABLE OF SHIELDING VIBRATION TRANSMISSION AND RECORDING APPARATUS AND LIQUID EJECTION APPARATUS INCLUDING THE CARRIAGE

BACKGROUND OF THE INVENTION

The present invention relates to a carriage on which a recording head is mounted, and a recording apparatus and a liquid ejection apparatus including its carriage.

In an ink jet printer or a thermal transfer type printer that is a kind of recording apparatus, a carriage on which a recording head is mounted is reciprocated in a direction orthogonal to the transporting direction of paper that is a recording medium (in a main scanning direction), whereby recording is performed. When forced vibration caused by cogging of a carriage motor is applied to this carriage, the recording head also vibrates, so that a good recording result is not obtained. Therefore, a printer has been proposed in which a small vibrator (dynamic vibration absorber) comprising a rubber elastic body and a dead-weight is attached to the carriage thereby to select and perform damping the resonance frequency of the carriage (JP-A-10-337924).

As described above, a small vibrator attached to a carriage of a conventional printer comprises a rubber elastic body and a dead-weight. Since a spring constant of this rubber elastic body is generally easy to change according to environment or with time, it is difficult to match exactly natural frequency of the small vibrator determined by spring constant of the rubber elastic body and mass of the dead-weight with natural frequency of the carriage over a long term, so that removal of the vibration of the carriage becomes incomplete.

Further, in order to prevent vibration transmission to the carriage, it is necessary to set the spring constant of the rubber elastic body low. However, in this case, deflection level of the small vibrator in acceleration and deceleration of the carriage increases, and position control property of the carriage worsens.

Further, in case that an effective working portion of the small vibrator is different according to carriages, a maximum vibro-isolating effect cannot be obtained in the respective carriages, using a single type small vibrator.

SUMMARY OF THE INVENTION

An object of the invention is to provide a carriage which can shield vibration transmission in movement over a long term, and a recording apparatus and a liquid ejection apparatus including its carriage.

Further, another object of the invention is to provide a carriage which can prevent vibration in movement to improve position control property, and a recording apparatus and a liquid ejection apparatus including its carriage.

In order to solve the above problems, a carriage according to the invention, on which a recording head is mounted, and to which a moving unit is connected, reciprocates a recording area by the moving unit to perform recording by the recording head. The carriage is characterized in that a recording head mount part and a connection part to the moving unit are separately provided and the mount part and the connection part are coupled by a coupling structure having elasticity. According to such the invention, for example, by providing a linear elastic member for the coupling structure, vibration from the moving unit is shielded in the division part and is not transmitted to the recording head mount part. Therefore, recording accuracy of the recording head can be kept in a high state.

Further, in order to solve the above problems, the invention is characterized in that the coupling structure has a regulating member for regulating a displacement of the linear elastic member. According to such the invention, large deflection of the linear elastic member produced in acceleration and deceleration of the carriage can be regulated by the regulating member.

Further, in order to solve the above problems, the invention is characterized in that a gap is provided between the linear elastic member and the regulating member. According to such the invention, small deflection of the linear elastic member produced in constant speed of the carriage can be absorbed in the gap.

Further, in order to solve the above problems, the invention is characterized in that the linear elastic member is a plate spring. Further, the invention is characterized in that the linear elastic member is a coil spring. According to such the invention, the carriage can have simple constitution.

Further, in order to solve the above problems, the invention is characterized in that the coupling structure has non-linear elasticity. According to such the invention, the coupling structure works weakly in a stroke in which the amplitude level of carriage vibration is small, and works strongly in a large stroke in carriage acceleration or deceleration, thereby to heighten position control property of the carriage. Therefore, recording accuracy of the recording head can be kept in a high state.

Further, in order to solve the above problems, the invention is characterized in that the coupling structure changes the elasticity thereof corresponding to a level of vibration produced in movement. According to such the invention, since it is possible to decrease the large deflection produced in acceleration and deceleration of the carriage and the small deflection produced in constant speed of the carriage, position control property of the carriage can be improved.

Further, in order to solve the above problems, the invention is characterized in that the coupling structure has a linear elastic member having linear elasticity and a regulating member for regulating a displacement of the linear elastic member. According to such the invention, the large deflection of the linear elastic member produced in acceleration and deceleration of the carriage can be regulated by the regulating member, and the small deflection produced in the constant speed of the carriage can be decreased.

Further, in order to solve the above problems, the invention is characterized in that a gap is provided between the linear elastic member and the regulating member. According to such the invention, small deflection of the linear elastic member produced in constant speed of the carriage can be absorbed in the gap.

Further, in order to solve the above problems, the invention is characterized in that the coupling structure is a spring member. According to such the invention, the carriage can have simple constitution.

Further, in order to solve the above problems, the invention is characterized in that the linear elastic member is a plate spring. Further, the invention is characterized in that the linear elastic member is a coil spring. According to such the invention, the carriage can have simple constitution.

In order to solve the above problems, a carriage according to the invention, on which a recording head is mounted, and to which a moving unit is connected, reciprocates a recording area by the moving unit to perform recording by the recording head. The carriage is characterized by providing a vibration absorbing unit which is adjustable to absorb vibration produced in movement. According to such the invention, the adjustment according to vibration in movement of the carriage can be performed on the vibration absorbing unit side. Therefore, the above vibration can be sufficiently removed over a long term and recording accuracy of the recording head can be kept in a high state.

Further, in order to solve the above problems, the invention is characterized in that the vibration absorbing unit is a device which oscillates by the vibration, and the oscillation width of the vibration absorbing unit is variable according to the frequency of the vibration so as to absorb the vibration. According to such the invention, since only the oscillation width of the vibration absorbing unit should be adjusted, the adjusting work becomes easy.

Further, in order to solve the above problems, the invention is characterized in that the vibration absorbing unit has a bar member of which one end is fixed, and a dead-weight member which is attachable to an arbitrary position of this bar member, and the oscillation width of the bar member is variable by changing the fixed position of the dead-weight member. According to such the invention, the vibration absorbing unit can have simple constitution.

Further, in order to solve the above problems, the invention is characterized in that the vibration absorbing unit has a vibration absorbing part which absorbs vibration produced in movement, and an angle position adjusting part which adjusts an angle position of the vibration absorbing part, and the angle position of the vibration absorbing part is adjusted by the angle position adjusting part according to the produced vibration thereby to absorb components of vibration in all the directions. According to such the invention, even if the vibration produced in the carriage is in any form, by adjusting the angle position of the vibration absorbing part according to its vibration form, its vibration can be sufficiently removed and recording accuracy of the recording head can be kept in a high state.

Further, the invention is characterized in that the vibration absorbing unit has an installation adjusting part which adjusts an installation position of the vibration absorbing part, and the installation position of the vibration absorbing part is adjusted by the installation adjusting part thereby to determine an absorbing range of the vibration. According to such the invention, a vibro-isolating effect can be heightened more.

Further, the invention is characterized in that the vibration absorbing unit is a device which oscillates by the vibration, and the oscillation width of the vibration absorbing unit is variable according to the frequency of the vibration so as to absorb the vibration. According to such the invention, since the oscillation width of the vibration absorbing unit should be adjusted, the adjusting work becomes easy.

Further, the invention is characterized in that the vibration absorbing part has a bar member of which one end is supported, and a dead-weight member which is attachable to an arbitrary position of this bar member, and the oscillation width of the bar member is variable by changing the fixed position of the dead-weight member. According to such the invention, the vibration absorbing part can have simple constitution.

Further, the invention is characterized in that the angle position adjusting part supports one end of the bar member and turns the bar member thereby to adjust the angle position of the vibration absorbing part. According to such the invention, the angle position adjusting part can have simple constitution.

Further, the invention is characterized in that the installation adjusting part supports one end of the bar member and moves the bar member thereby to adjust the installation position of the vibration absorbing part. According to such the invention, the installation adjusting part can have simple constitution.

In order to solve the above problems, a recording apparatus of the invention, which performs recording on a recording medium, is characterized by including the above each carriage. Further, in order to solve the above problems, a liquid ejection apparatus of the invention, which ejects liquid onto an ejected medium, is characterized by including the above each carriage.

According to such the invention, it is possible to provide the recording apparatus or the liquid ejection apparatus which obtains the above each working effect

DESCRIPTION OF THE PREFERRED EMBODIMENTS

Embodiments of the invention will be described below in detail with reference to drawings. Here, in the attached drawings, the same members are denoted by the same reference symbols, and the overlapping description is omitted. Further, the embodiment of the invention has a form which is particularly useful to carry out the invention, and the invention is not limited to its embodiment.

Figure 1:
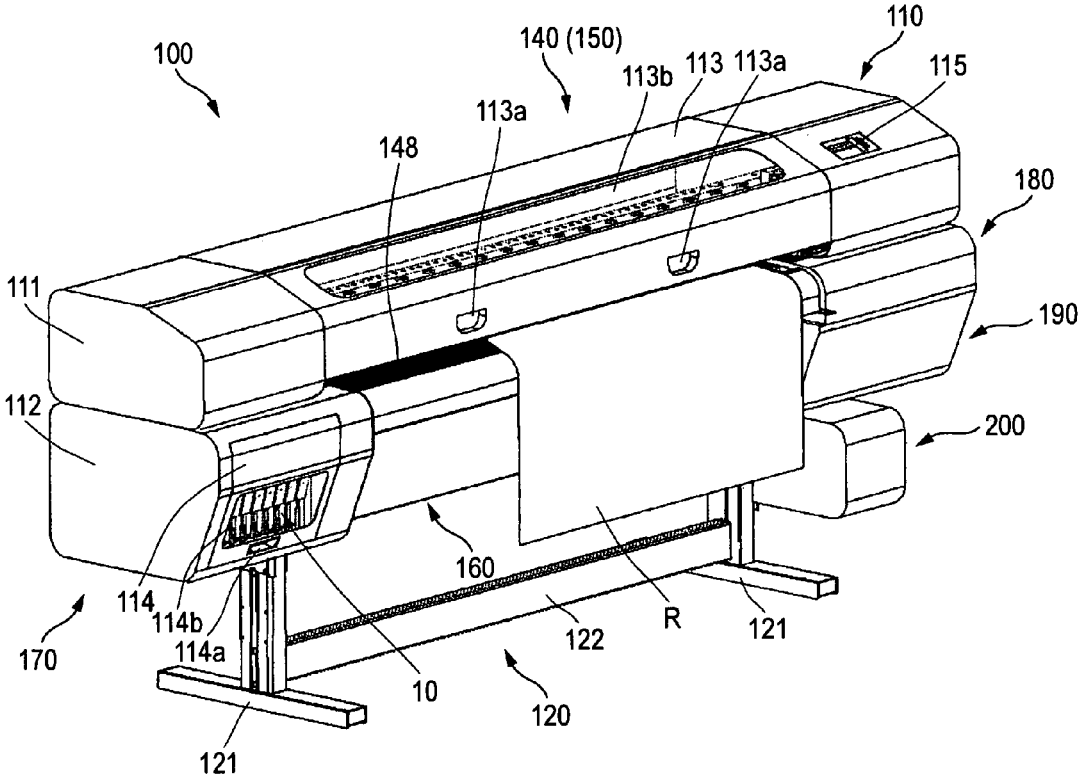
FIG. 1 is a first perspective view showing an external constitution example of an ink jet printer which is a kind of recording apparatus according to an embodiment of the invention, viewed from the front.
Figure 2:
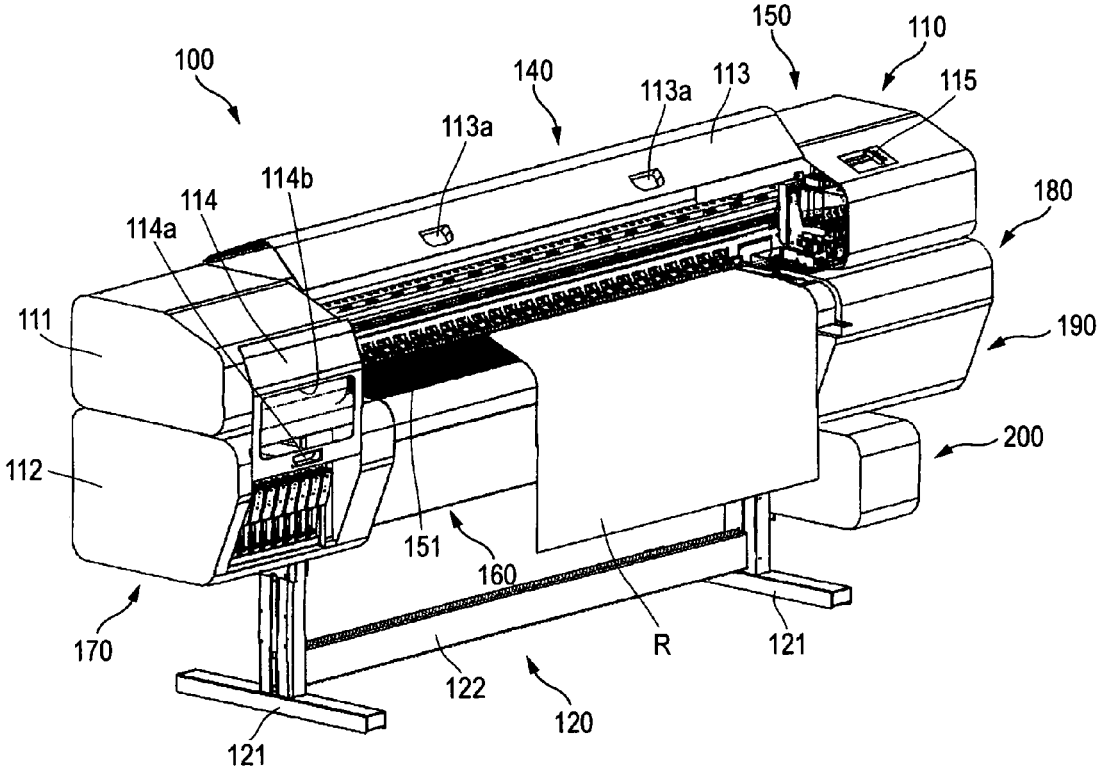
FIG. 2 is a second perspective view showing the external constitution example of the printer in FIG. 1, viewed from the front.
Figure 3:
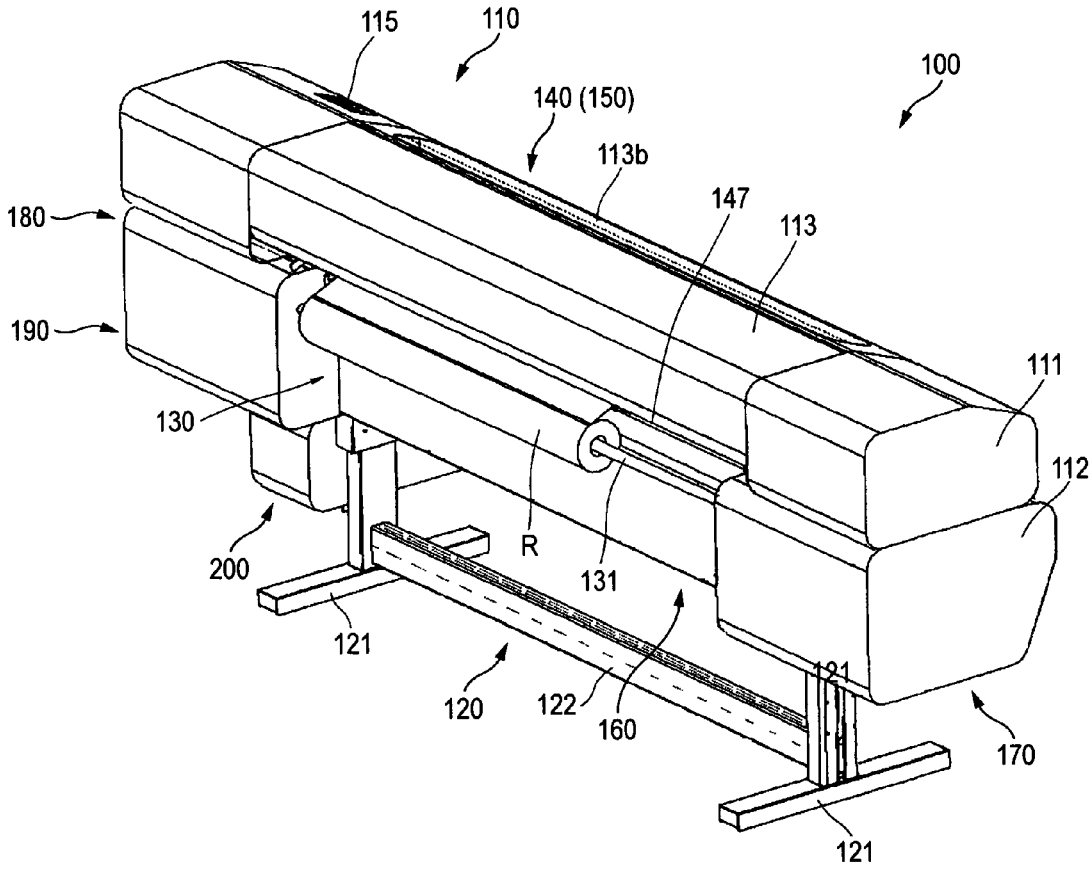
FIG. 3 is a perspective view of the printer in FIG. 1, viewed from the back.
Figure 4:
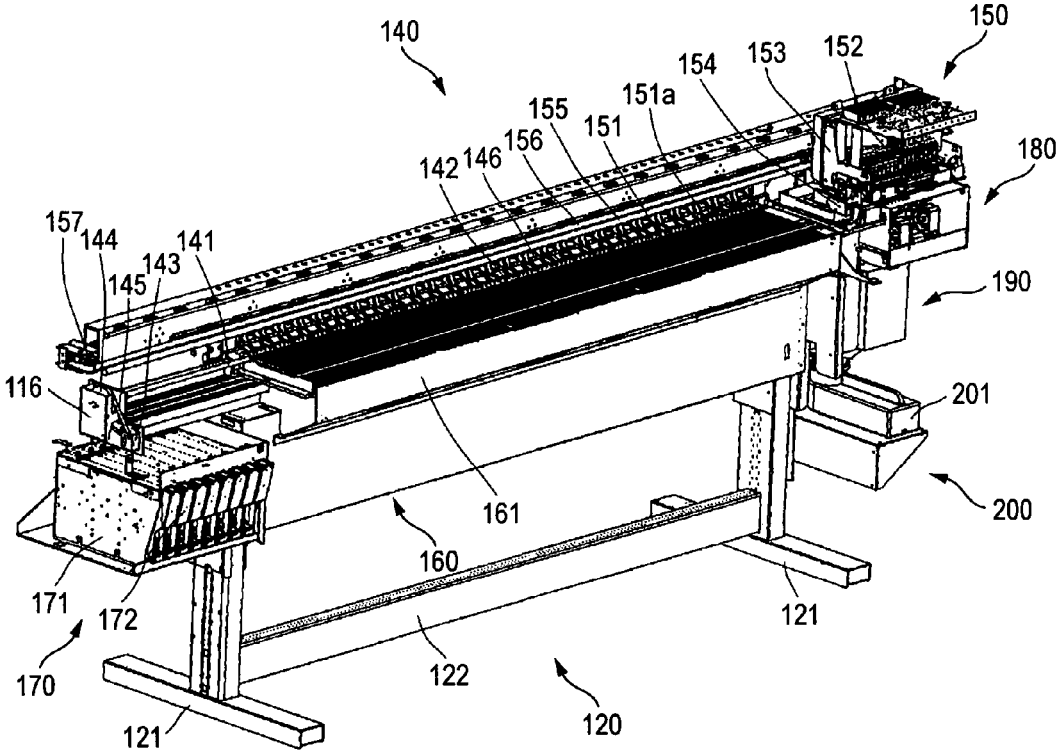
FIG. 4 is a perspective view showing the internal structure of the printer in FIG. 1.

FIGS. 1 and 2 are perspective views showing an external constitution example of an ink jet printer which is a kind of recording apparatus according to an embodiment of the invention, viewed from the front, FIG. 3 is a perspective view of its printer in FIG. 1, viewed from the back, and FIG. 4 is a perspective view showing the internal structure of its printer. This ink jet printer 100 is a large-sized printer which can perform recording on cut paper of comparatively large size such as AO-size in JIS (Japanese Industrial Standard) or BO-size in JIS, and also on roll paper R having their paper width. This ink jet printer 100, as shown in FIGS. 1 to 4, comprises a rectangular parallelepiped-shaped printer body part 110 and a printer leg part 120 which supports this printer body part 110.

The printer body part 110, as shown in FIGS. 1 to 4, is divided into two portions up and down. As shown in FIG. 3, at a boundary portion between the upper and lower portions on a backside, a roll paper housing part 130 is installed. Further, as shown in FIGS. 1 to 4, in the upper portion, a paper discharge part 140, and a recording part 150 including a characteristic part of the invention are installed. Further, as shown in FIGS. 1 to 4, in the center of the lower portion, a paper suction part 160 is installed; on the left side of the lower portion viewed from the front, an ink supply part 170 is installed; and on the right side of the lower portion viewed from the front, a head property recovery part 180 and a drive control part 190 are installed up and down. Further, as shown in FIGS. 1 to 4, below the drive control part 190 and by the side of the printer leg part 120, a waste ink recovering part 200 is installed.

The printer body part 110, as shown in FIGS. 1 to 3, comprises a upper housing 111 made of plastic or sheet metal which covers the paper discharge part 140 and the recording part 150, and a lower housing 112 made of plastic or sheet metal which covers the paper suction part 160, the ink supply part 170, the head property recovery part 180, and the drive control part 190. Further, the upper housing 111, as shown in FIG. 2, has a body cover 113 which is installed openably from the central front to the central upper surface and made of plastic or sheet metal. Further, the lower housing 112, as shown in FIG. 2, has an ink cover 114 which is installed so that the front surface of the ink supply part 170 is openable and made of plastic or sheet metal.

The body cover 113, as shown in FIGS. 1 and 2, is supported rotatably at its rear end by the upper housing 111, and opens or closes by being pushed up or down by a user with his finger into a concave finger-catch portion 113*a* formed on its front surface. The user, since he can open greatly the upsides of the paper discharge part 140 and the recording part 150 by opening the body cover 113, can easily perform a maintenance operation of the recording head 152 and the carriage 153, and a release operation of a paper feed error such as paper jam during recording or during transportation. Further, the body cover 113, as shown in FIGS. 1 and 3, has a transparent or semitransparent window 113*b* made of plastic at a part of its upper surface. The user can look in the inside through the window 113*b* without opening the body cover 113 thereby to confirm visually a recording state or a transportation state.

The ink cover 114, as shown in FIGS. 1 and 2, is slidably supported at its both sides by the lower housing 112, and opens or closes by being pushed up or down by the user with his finger into a concave finger-catch portion 114*a* formed on its front surface. The user, since he can open greatly the front surface of the ink supply part 170 by opening the ink cover 114, can easily perform an exchange operation of an ink cartridge 10. Further, the ink cover 114, as shown in FIGS. 1 and 2, has a transparent or semitransparent window 114*b* made of plastic at a part of its front surface. The user can look in the inside through the window 114*b* without opening the ink cover 114 thereby to confirm visually a state of the ink cartridge 10.

Further, in the printer body 110, as shown in FIGS. 1 to 3, on the upper surface of the right upper portion viewed from the front, an operation panel 115 for operating recording control by the user is installed. This operation panel 115 includes a liquid crystal screen and various buttons, and the user can operates the buttons while looking at and confirming the liquid crystal screen. Since the user can perform the sure operation by visual confirmation, the operation error and the operation miss can be eliminated.

The printer leg part 120 comprises, as shown in FIGS. 1 to 4, two reverse T-shaped support pillars 121, and a reinforcement pillar 122 laid between these support pillars 121. On the upper portion of the support pillars 121, the printer body 110 is placed and screwed. Since the printer body 110 is put in a state where it is lifted through the printer leg part 120, the user performs easily paper supply and discharge processing, and various maintenance processing. Further, since a discharged paper receiving part can be installed in space of the printer leg part 120, the user can efficiently recover the paper on which data has been recorded, and prevent it from being stained.

The roll paper housing part 130, as shown in FIG. 3, comprises a spindle 131 which is inserted into the inner circumferential portion of the roll paper R and supports the roll paper R, and not-shown bearings which support both ends of this spindle 131 rotatably. The back surface of the paper suction part 160 is formed more concavely than the back surface of the ink supply part 170, and the back surfaces of the head property recovery part 180 and the drive control part 190 which are located on the both sides of the paper suction part 160, and by use of this concave portion, the roll paper housing part 130 is installed.

Namely, in the opposite side surfaces of the ink supply part 170, and the head property recovery part 180 and drive control part 190, not-shown bearings are included, which support both ends of the spindle 131 rotatably in the main scanning direction. Between these bearings, the spindle 131 which penetrates the inner circumferential portion of the roll paper R is laid, whereby the roll paper R can be set without protruding from the back surface of the printer body 110.

The paper supply and discharge part 140, as shown in FIG. 4, includes a paper feed roller 141 and its paper feed driven roller 142. The paper feed roller 141 and its paper feed driven roller 142, on the paper supply downstream side close to the roll paper housing part 130, that is, on the back side in the printer body 110, are arranged so that their axes face in the main scanning direction and their circumferential surfaces are opposed to each other up and down. The paper feed roller 141 is formed as one long roller, and its circumferential surface portion that is a little larger than the maximum recordable paper width is coated with ceramic powder. Hereby, since slip in paper feed can be prevented, the paper can be fed out with high accuracy. This paper feed roller 141 is supported at its both ends by a side frame 116 through not-shown bearings, and is rotated forward and backward by drive power transmitted through a pulley 144 and a belt 145 from a paper feed motor 143.

The paper feed driven roller 142 comprises plural short rollers, and they are supported rotatably by plural driven roller support members 146 which are arranged in parallel upward of the paper feed roller 141 in the axial direction. This paper feed driven roller 142 is pressed against the paper feed roller 141 by an energizing member such as a not-shown spring attached to the driven roller support member 146, and rotates forward and backward in accordance with the forward and backward rotation drive of the paper feed roller 141. Hereby, since the paper can be fed out, pressed from its both sides, recording can be performed with high accuracy. Further, the paper feed roller 141 and its paper feed driven roller 142 hold between them the roll paper R or the cut paper supplied from a paper supply port 147 formed between the upper and lower portions of the printer body 110 shown in FIG. 3, feed out the paper onto a platen 151 of the recording part 150 shown in FIGS. 2 and 4, and discharge the paper from a paper discharge port 148 formed between the upper and lower portions of the printer body 110 shown in FIG. 1.

The recording part 150, as shown in FIGS. 2 and 4, includes the platen 151 arranged on the transportation-downstream side close to the paper feed roller 141, a carriage 153 mounted with a recording head 152, which is a characteristic portion of the invention, and a cutter 154 attached to the carriage 153. Further, the recording part 150 includes a not-shown flexible flat cable (hereinafter referred to as FFC) which connects electrically the recording head 152 and the drive control part 190 for executing recording, and an ink tube which connects the recording head 151 and an ink cartridge 10 in which ink is filled.

The platen 151 is formed in the shape of a rectangular flat plate having the length a little larger than the maximum recordable paper width, and installed along the paper feed roller 141. This platen 151 has plural holes (not shown) connecting to the paper suction part 160 from its surface to its rear surface, and has on its surface plural uneven portions (not shown) for absorbing cockling of paper caused by moisture absorption. Hereby, since the paper during recording can be kept nearly flat, recording with high accuracy can be performed.

Further, on the surface of the platen 151, a cutter groove 151*a* extending in the main scanning direction is formed. This cutter groove 151*a* has such a size that a blade edge of the cutter 154 protruding from the downside of the roll paper R can get in the cutter groove 151*a* to prevent the surface of the platen 151 from being injured by the cutter 154 when the cutter 154 cuts the roll paper R in the width direction. Hereby, the recorded portion of the roll paper R can be surely cut off from a non-recorded portion.

The recording head 152 is arranged at the lower portion of the carriage 153 so as to be opposed to the cut paper or the roll paper R supplied onto the upper surface of the platen 151 with the predetermined space, and has a recording head for black ink which ejects two kinds of black ink, and a recording head for plural color ink which ejects ink of each color of cyan, magenta, yellow, a red, blue, and gloss optimizer. Further, the recording head 152 has a pressure generating chamber and a nozzle opening that connects to the pressure generating chamber. By applying pressure into the pressure generating chamber storing ink at the predetermined pressure, an ink droplet of which a size is controlled is ejected from the nozzle opening to the cut paper or the roll paper R supplied onto the upper surface of the platen 151.

The carriage 153 is placed through a not-shown bearing on a carriage guide shaft 155 provided in the main scanning direction, and connected to a belt 156. The carriage 153, when the pulley 157 constituting a not-shown moving unit is rotated by the carriage motor constituting the moving unit and then the belt 156 constituting the moving unit turns, cooperates with the movement of the belt 156, and is guided by the carriage guide shaft 155 to reciprocate in the main scanning direction. Hereby, since the carriage 153 can be moved with high accuracy, recording with high accuracy can be performed.

The cutter 154 is installed so that it can go up and down with the blade edge facing downward and move in the main scanning direction. This cutter 154 is moved up and down by, for example, a solenoid, and moved together with the carriage 153 in the main scanning direction. Accordingly, since it is not necessary to provide a device for moving the cutter 154 separately, space can be saved, and the cost can be kept. Further, the cutter 154 may be constituted so that it is separated from the carriage 153 and moves in the main scanning direction by a peculiar belt mechanism and a motor.

The FFC, of which one end is connected to a connector of the drive control part 190, and of which the other end is connected to a connector of the recording head 152, sends a recording signal from the drive control part 190 to the recording head 152. Regarding the ink tube, the ink tube for ink of each color is installed, one end of each tube is connected through an ink press-supply means (not shown) to the ink cartridge of each corresponding color, and the other end is connected to the recording head 152 for each corresponding color. Further, the ink tube sends the ink of each color pressurized by the ink press-supply means from the ink cartridge 10 to the recording head 152.

The paper suction part 160, as shown in FIG. 4 is provided with a pressure chamber 161 arranged at the lower portion of the platen 151, and a not-shown fan arranged at the lower portion of the pressure chamber 161. The pressure chamber 161 is formed in the shape of a box opened at an upper surface and a part of a bottom surface, to the opening portion of the upper surface, the platen 151 is attached, and to the opening portion of the bottom surface, the fan is attached. By turning the fan, air is sucked into the pressure chamber 161 from the holes provided in the platen 151, and exhausted through the fan to the outside. Accordingly, when the cut paper or the roll paper R is supplied onto the upper surface of the platen 151, negative pressure is generated on the downside of the cut paper or the roll paper R, so that the cut paper or the roll paper R can be absorbed on the upper surface of the platen 151 thereby to prevent a bulge of the cut paper or the roll paper R, and recording accuracy can be kept high.

The ink supply part 170, as shown in FIG. 4, comprises a box-shaped cartridge housing part 171, and a cartridge press part 172 attached to the front surface side of the cartridge housing part 171. The cartridge housing part 171 is partitioned so that the ink cartridges 10 of eight colors; two kinds of black, cyan, magenta, yellow, red, blue, and gloss optimizer in this order from the left can be individually pulled out and pushed in from the front surface side. The cartridge press part 172 is attached openably and closeably to each partition portion of the cartridge housing part 171, presses the ink cartridge 10 in the partition portion in cooperation with the closing operation, and protrudes the ink cartridge 10 in the partition portion in cooperation with the opening operation.

Here, in the ink cartridge 10, in an exterior case formed of, for example, rigid plastic material in the shape of a rectangular parallelepiped, an ink tank which is formed in the shape of a bag made of, for example, a flexible material and filled with ink is airtightly set. Further, on a surface of the ink cartridge 10 on the insertion side to the cartridge housing part 171, an ink supply port connecting to the ink tank and a positioning hole in the cartridge housing part 171 are formed. On the other hand, on the inner back surface of the cartridge housing part 171, an ink supply needle inserted into the ink supply port of the ink cartridge 10, and a positioning needle inserted into the positioning hole of the ink cartridge 10 are arranged so as to protrude in the pulling-out and pushing-in direction of the ink cartridge 10.

Accordingly, when the cartridge press part 172 is closed, the positioning needle is automatically inserted into the positioning hole, whereby the ink cartridge 10 housed into the cartridge housing part 171 is positioned. Simultaneously, the ink supply needle is automatically inserted into the ink supply port, whereby the ink can be supplied to the recording head 152. Further, when the cartridge press part 172 is opened, the positioning needle is automatically pulled out from the positioning hole, and simultaneously the ink supply needle is automatically pulled out from the ink supply port.

The head property recovery part 180 is arranged below the carriage 153 located in a home position shown in FIG. 4, and comprises a wiping unit, a capping unit, a suction unit, and a drive unit for these units. The wiping unit has a wiper formed of rubber, felt, or plastics nearly in the shape of a rectangular flat plate, and rubs a nozzle forming surface of the recording head 152 thereby to wipe off the ink adhering onto the nozzle forming surface.

The capping unit has a cap formed of rubber nearly in the shape of a rectangular parallelepiped, and a depression provided for the upper portion of the cap is pressed on the nozzle forming surface of the recording head 152 thereby to seal the nozzle opening. The suction unit absorbs and exhausts the ink forcedly in order to remove clogging of the nozzle opening and the mixed air bubbles. Therefore, the head property recovery part 180, when the carriage 153 is located in the home position, can perform processing for keeping ink ejection property of the recording head 152 in a constant state.

The waste ink recovery part 200 has a waste liquid cartridge 201 attached removably. The waste liquid cartridge 201 stores ink used for the purpose of initial filling in an ink supply system leading to the recording head 152, or waste liquid such as cleaning liquid used in cleaning of the ink supply system leading to the recording head 152. Hereby, by only exchanging the waste liquid cartridge 201, processing of the waste liquid can be completed. Therefore, the number of working steps can be reduced, and stains around the printer can be prevented.

Figure 5:
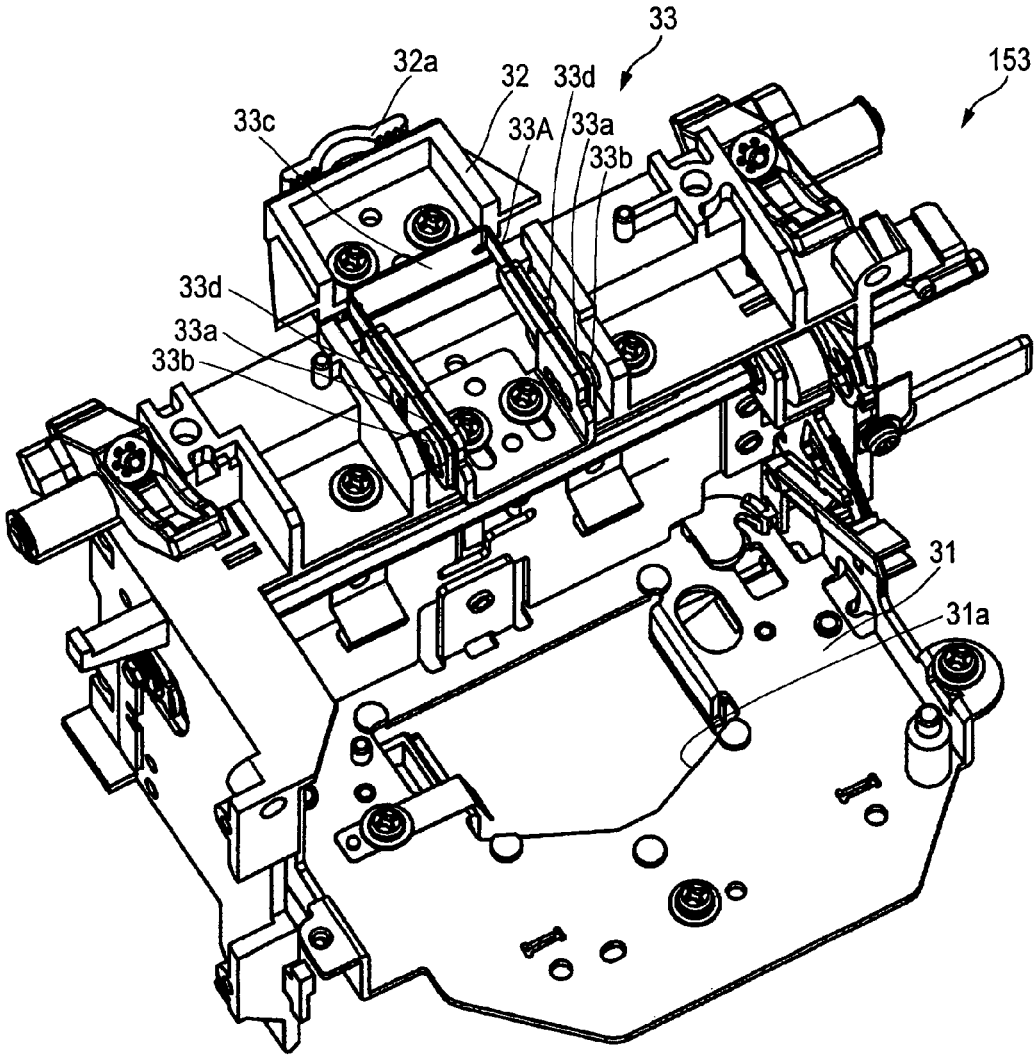
FIG. 5 is a perspective view showing the details of a carriage of the printer in FIG. 1, which shows a characteristic portion of the invention.
Figure 6:
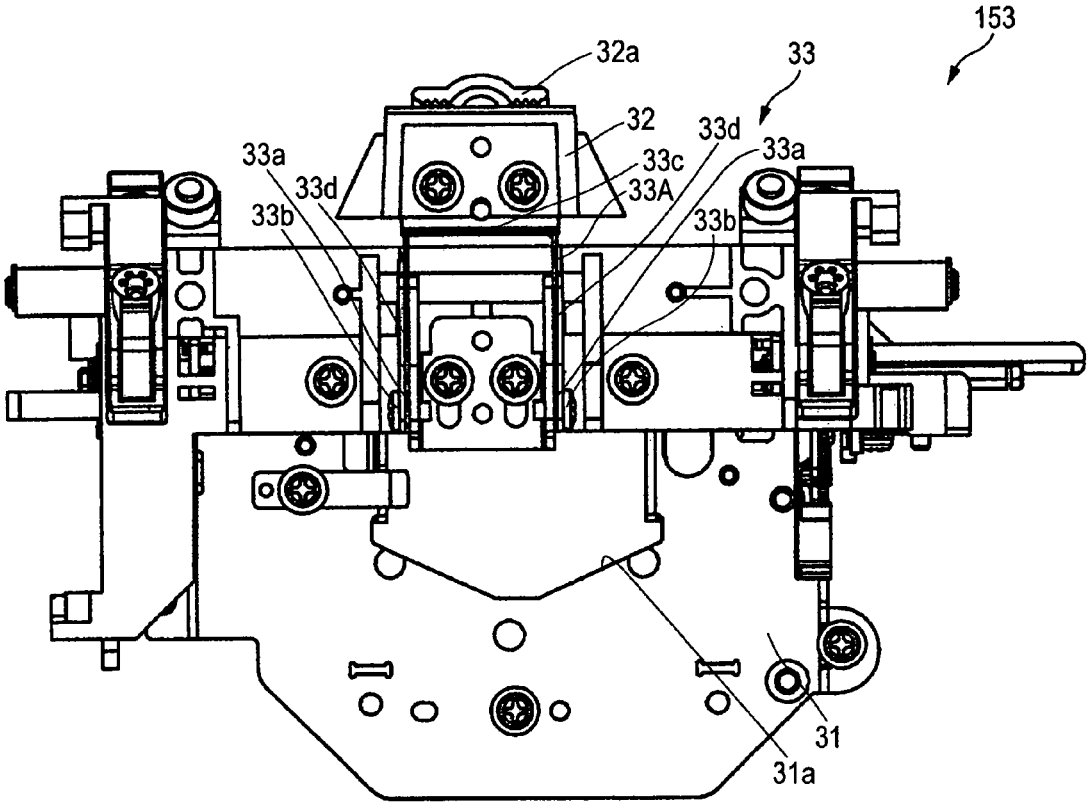
FIG. 6 is a plan view of the carriage in FIG. 5.

FIG. 5 is a perspective view showing the details of a carriage 153 according to a first embodiment of the invention, and FIG. 6 is a plan view of its carriage. This carriage 153 comprises a mount part 31 on which a recording head 152 is mounted, a connection part 32 connected to a belt 156, and a coupling structure 33 which couples the mount part 31 and the connection part 32. In the bottom surface of the mount part 31, a hole 31*a* to which a nozzle forming surface of the recording head 152 is exposed is formed, the recording head 152 is mounted to this hole 31*a*, and a damper or the like is further mounted thereon. The connection part 32 has on its back surface a clamping part 32*a* in which the belt 156 is held, and this clamping part 32*a* and the belt 156 are connected.

The coupling structure 33 has a nearly C-shaped plate spring that is a kind of linear elastic member 33A, and is attached to the connection part 32 so that a pair of free ends 33*a* protrude. Further, a pair of free ends 33*a* are attached to the mount part 31 by a pair of screws 33*b* facing in the main scanning direction. Therefore, in the coupling structure 33, for an attachment portion 33*c* of the connection part 32, an attachment portion 33*d* of the mount part 31 can oscillate in the main scanning direction.

Here, a case in which forced vibration $P_0 \cos \omega t$ produced by cogging of a carriage motor and represented by the following expression (1) is applied to the carriage 153 will be thought:

$$P_0 \cos \omega t = ma + kx \quad (1),$$

wherein $P_0$ is level of the forced vibration, ω is frequency of the forced vibration, t is time, m is mass of the mount part 31 of the carriage 153, a is acceleration of the carriage 153, k is spring constant of the coupling structure 33, and x is displacement of the coupling structure 33.

Figure 7A:
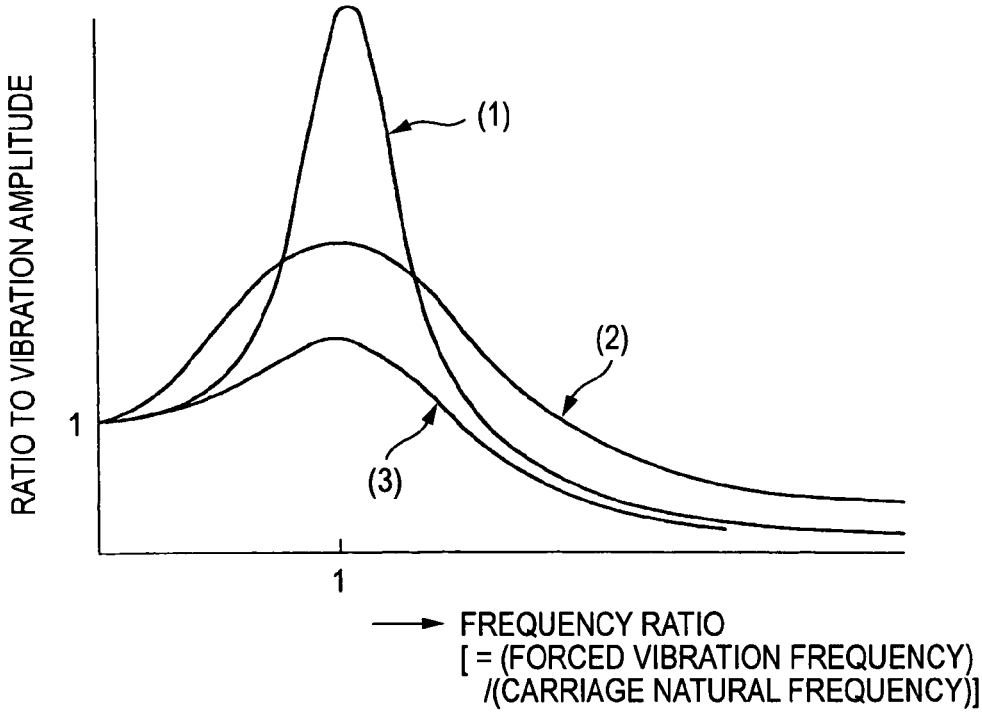
FIG. 7A is a diagram showing vibration forms of the carriage in FIG. 5.

In this case, natural frequency $p=\sqrt{(k/m)}$ of the mount part 31 of the carriage 153 is set so as to keep away from the frequency ω of the forced vibration, for example, so as to be ω/p=2 and more, whereby the forced vibration $P_0 \cos \omega t$ produced by cogging of the carriage motor is absorbed by the coupling structure 33, so that it is possible to prevent the forced vibration from transmitting to the mount part 31 of the carriage 153 (refer to FIG. 7A). Therefore, the recording head 152 mounted on the mount part 31 of the carriage 153, without receiving the influence by the forced vibration $P_0 \cos \omega t$ produced by cogging of the carriage motor, can obtain a good recording result. Further, in case that a ratio of frequency is set larger (in case that p is set smaller) coupling is too weak, so that control of the carriage movement becomes difficult. According to a test, it is preferable that ω/p is set to 2-6.

Figure 7B:
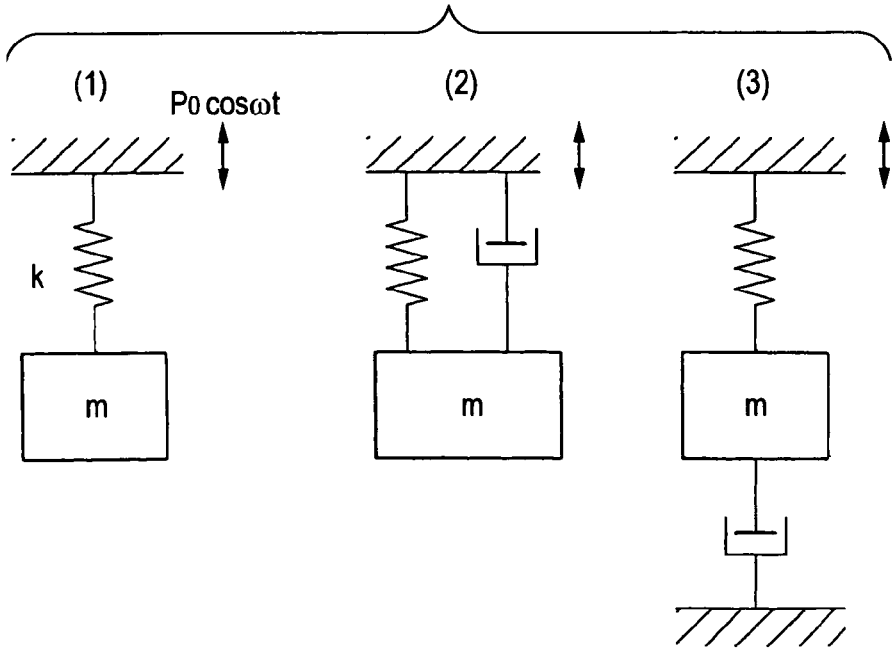
FIG. 7B is a diagram showing vibration models of coupling structure.

As shown in vibration models of FIG. 7B, not only a spring element (model in FIG. 7B (1)) but also a damping element (models in FIGS. 7B (2) and (3)) can be added to coupling. In this case, addition in series (FIG. 7B (3)) is more effective than addition in parallel (FIG. 7B (2)). This can be specifically realized by a method in which in a guide portion of the carriage 153, a guide member is used, which is constituted so that damping is obtained by press-friction against the carriage shaft 155 that is a fixed member by energy of a spring.

In the above first embodiment, though the plate spring is used as the linear elastic member 33A of the coupling structure 33, the linear elastic member is not limited particularly as long as a relation between a load and displacement has a linear property. For example, also in case that a coil spring is used, the similar effect is obtained. In this case, each one end of a pair of coil springs arranged in series so that the displacement direction faces in the main scanning direction is attached to both ends of the connection part 32, and the other ends of a pair of coil springs are attached to the mount part. Namely, a pair of coil springs are arranged so as to put the connection part 32 between. Hereby, since the mount part 31 can oscillate in relation to the connection part 32 in the main scanning direction, the forced vibration $P_0 \cos \omega t$ produced by cogging of the carriage motor can be absorbed by the coupling structure 33.

As described above, according to the carriage 153 in the first embodiment, the mount part 31 of the recording head 152 and the connection part 32 to the belt 156 are separately provided, and the mount part 31 and the connection part 32 are coupled by the coupling structure 33 having the linear elastic member 33A. Therefore, the vibration from the belt 156 is shielded at the division portion and is not transmitted to the mount part 31 of the recording head 152, so that recording accuracy of the recording head 152 can be kept in a high state.

Figure 8:
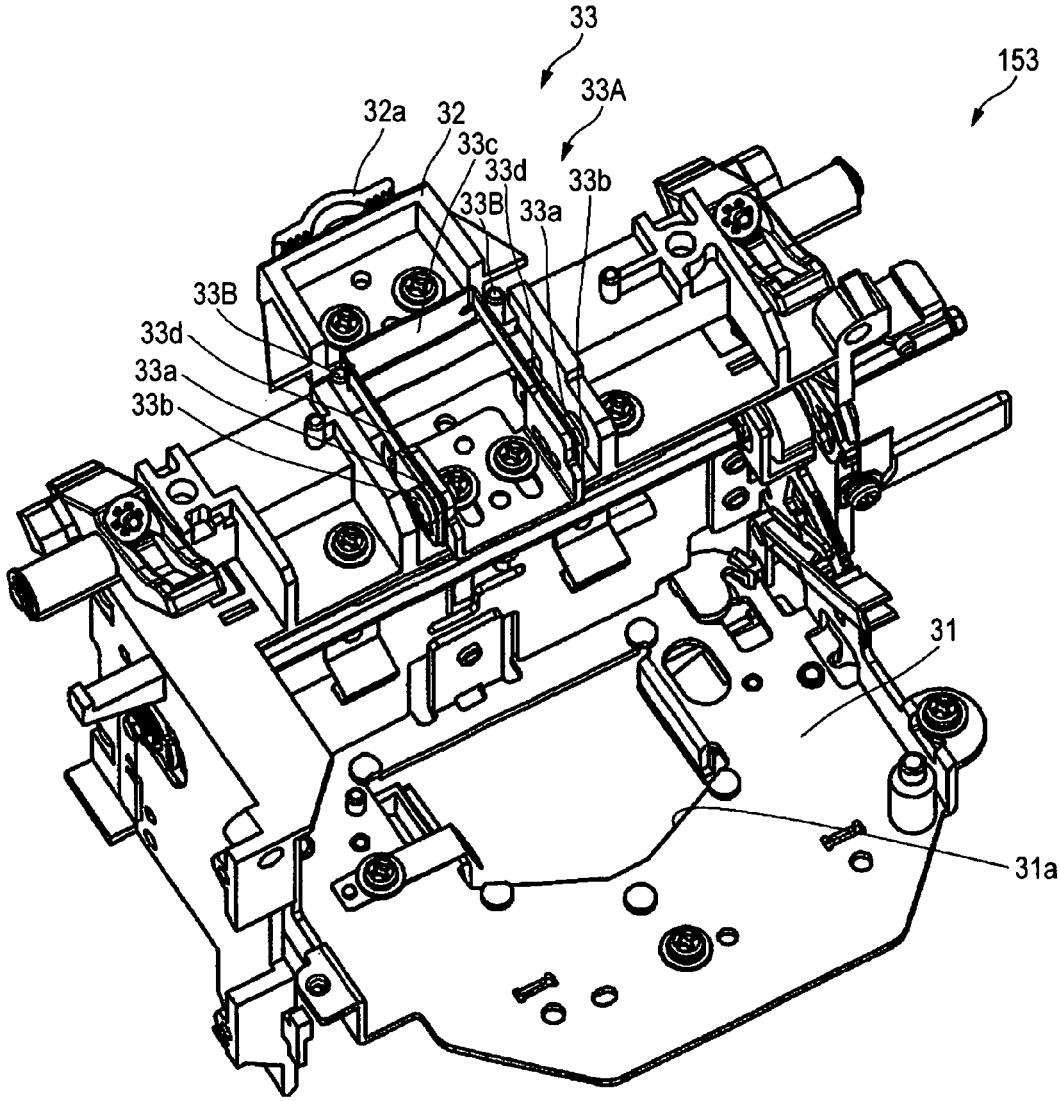
FIG. 8 is a perspective view showing details of another example of the carriage of the printer in FIG. 1, which shows the characteristic portion of the invention.
Figure 9:
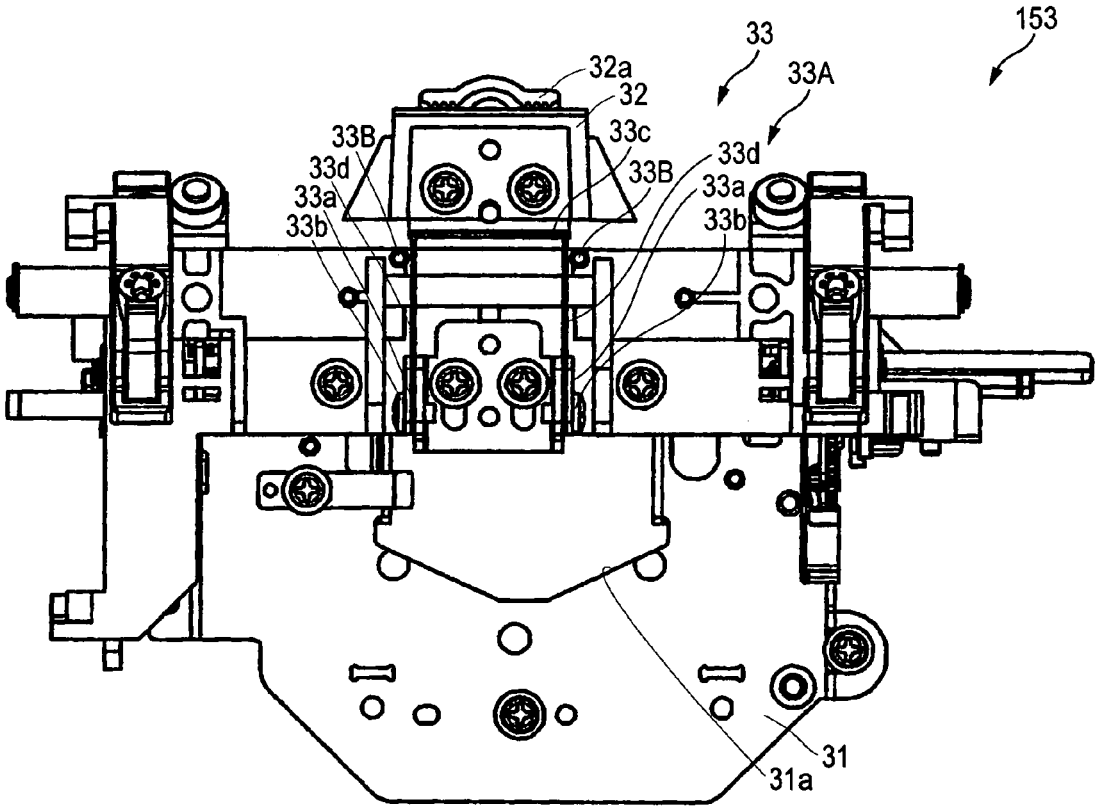
FIG. 9 is a plan view of the carriage in FIG. 8.

FIG. 8 is a perspective view showing the details of a carriage 153 according to a second embodiment of the invention, which corresponds to FIG. 5, and FIG. 9 is a plan view of the carriage in FIG. 8, corresponding to FIG. 6, wherein the same components are denoted by the same reference numerals and their description is omitted. A coupling structure of this carriage 153 includes, in addition to the above linear elastic member 33A, a regulating member 33B which regulates displacement of the linear elastic member 33A.

The regulating member 33B, as shown in FIGS. 8 and 9, comprises two cylindrical pins, which are arranged on the both outsides of an attachment portion 33*d* of a mount part 31, and in the vicinity of an attachment portion 33*c* of a connection part 32. Further, these regulating members 33B are attached onto the mount part 31 with the predetermined gap from the attachment portion 33*d* of the mount part 31 which is in a static state, for example, with a gap of several tens of micrometers. Hereby, large deflection of the linear elastic member 33A produced in acceleration and deceleration of the carriage 153, that is, delay of the carriage 153 can be regulated by the physical regulating member 33B, so that position control property of the carriage 153 can be improved.

In the above second embodiment, through the regulating member 33B (pin) is another member from the mount part 31, it may be formed integrally with the mount part 31. Further, though the regulating member 33B (pin) is arranged on the both outsides of the attachment portion 33*d* of the mount part 31, and in the vicinity of the attachment portion 33*c* of the connection part 32, even if it may be arranged on the both insides of the attachment portion 33*d* of the mount part 31, the similar effect is obtained. Further, the regulating member 33B may be arranged between the attachment portion 33*c* of the connection part 32 and a free end 33*a*. Hereby, when the linear elastic member 33A (plate spring) comes into contact with the regulating member 33B (pin), a sudden change in displacement of the linear elastic member 33A (plate spring) such as that in the above embodiment can be prevented.

As described above, according to the carriage 153 in the second embodiment, since the coupling structure 33 has the regulating member 33B which regulates the displacement of the linear elastic member 33A, the large deflection of the linear elastic member 33A produced in acceleration and deceleration of the carriage 153 can be regulated by the regulating member 33B. Further, since the gap is provided between the linear elastic member 33A and the regulating member 33B, small deflection of the linear elastic member 33A produced in a constant speed of the carriage 153 can be absorbed in the gap.

Next, referring to FIGS. 8 and 9, a carriage 153 according to a third embodiment of the invention will be described. A coupling structure 33 shown in FIGS. 8 and 9 has non-linear elasticity, and the elasticity changes correspondingly to a level of vibration produced in movement of the carriage 153. Hereby, large deflection of a linear elastic member 33A produced in acceleration and deceleration of the carriage 153, that is, delay of the carriage 153 can be regulated by a physical regulating member 33B, so that position control property of the carriage 153 can be improved. Further, small deflection produced in a constant speed of the carriage 153 can be reduced, so that vibro-isolating performance of the carriage 153 can be heightened.

In the above third embodiment, though the linear elastic member 33A (plate spring) and a regulating member 33B (pin) are used as the linear elastic member 33A, the linear elastic member is not limited particularly as long as a relation between a load and displacement has a non-linear property. For example, also in case that a spring member having non-linear elasticity is used, the similar effect is obtained. Such the spring member can be realized by a leaf spring in which flat plate-shaped plate springs having the predetermined length are stuck onto free ends of both sides of a nearly C-shaped plate spring.

Further, the above spring member can be realized also by a coil spring of which diameter changes, for example, a nearly conical spring of which diameter becomes small gradually, or a composite coil spring in which plural coil springs which are different in diameter are arranged coaxially. In this case, each one end of a pair of coil springs arranged in series so that the displacement direction faces in the main scanning direction is attached to both ends of a connection part 32, and the other ends of a pair of coil springs are attached to a mount part. Namely, a pair of coil springs are arranged so as to put the connection part 32 between. Hereby, the mount part 31 can oscillate in relation to the connection part 32 in the main scanning direction, so that the similar effect to the above-mentioned effect can be obtained.

As described above, according to the carriage 153 in the third embodiment, the mount part 31 of the recording head 152 and the connection part 32 to a belt 156 are separately provided, and the mount part 31 and the connection part 32 are coupled by the coupling structure 33 having the non-linear elasticity. Therefore, in the coupling structure 33, the elasticity changes correspondingly to a level of the vibration produced in the movement time. Therefore, the coupling structure 33 works weakly in a stroke in which the amplitude level of carriage vibration is small, and works strongly in a large stroke in carriage acceleration or deceleration, thereby to heighten position control property of the carriage 153.

Figure 10:
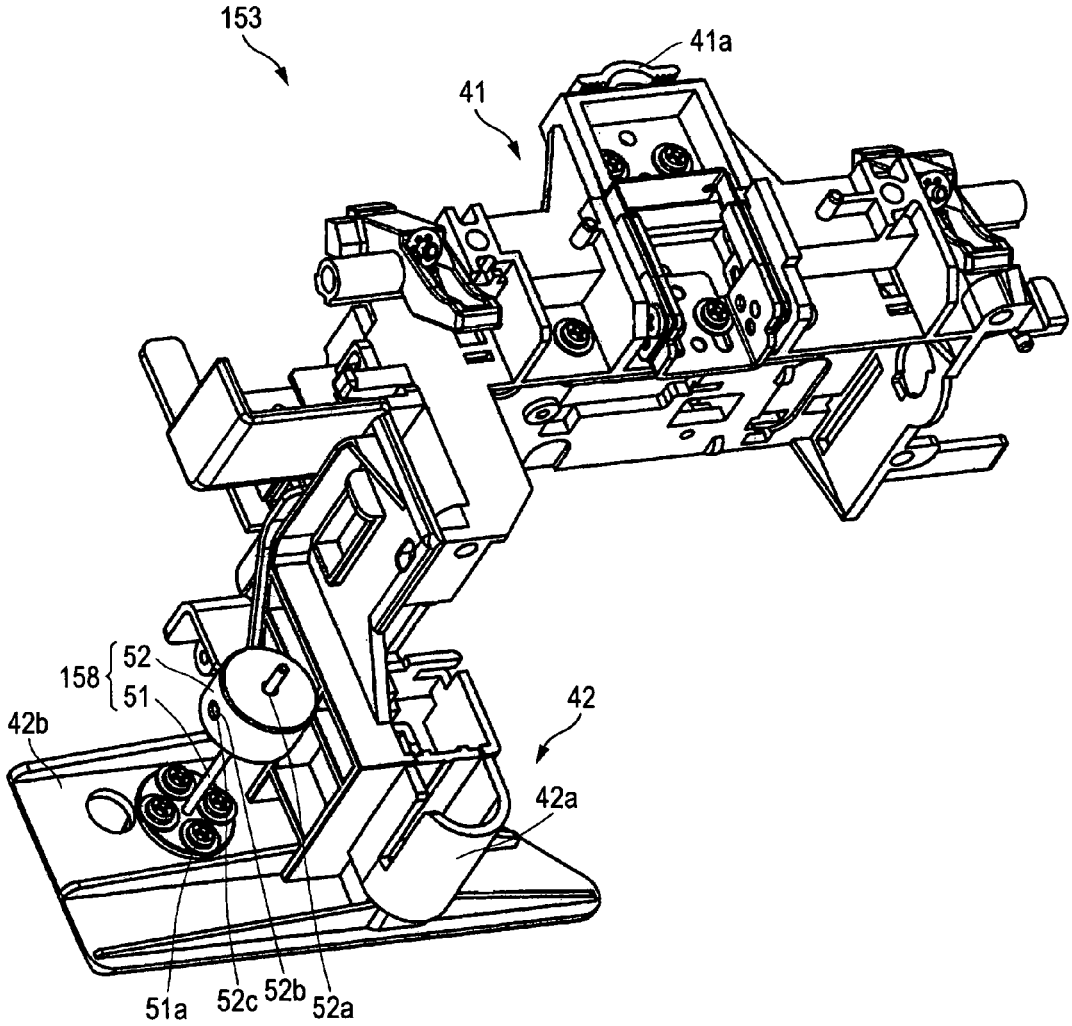
FIG. 10 is a perspective view showing details of another example of the carriage of the printer in FIG. 1, which shows the characteristic portion of the invention.
Figure 11:
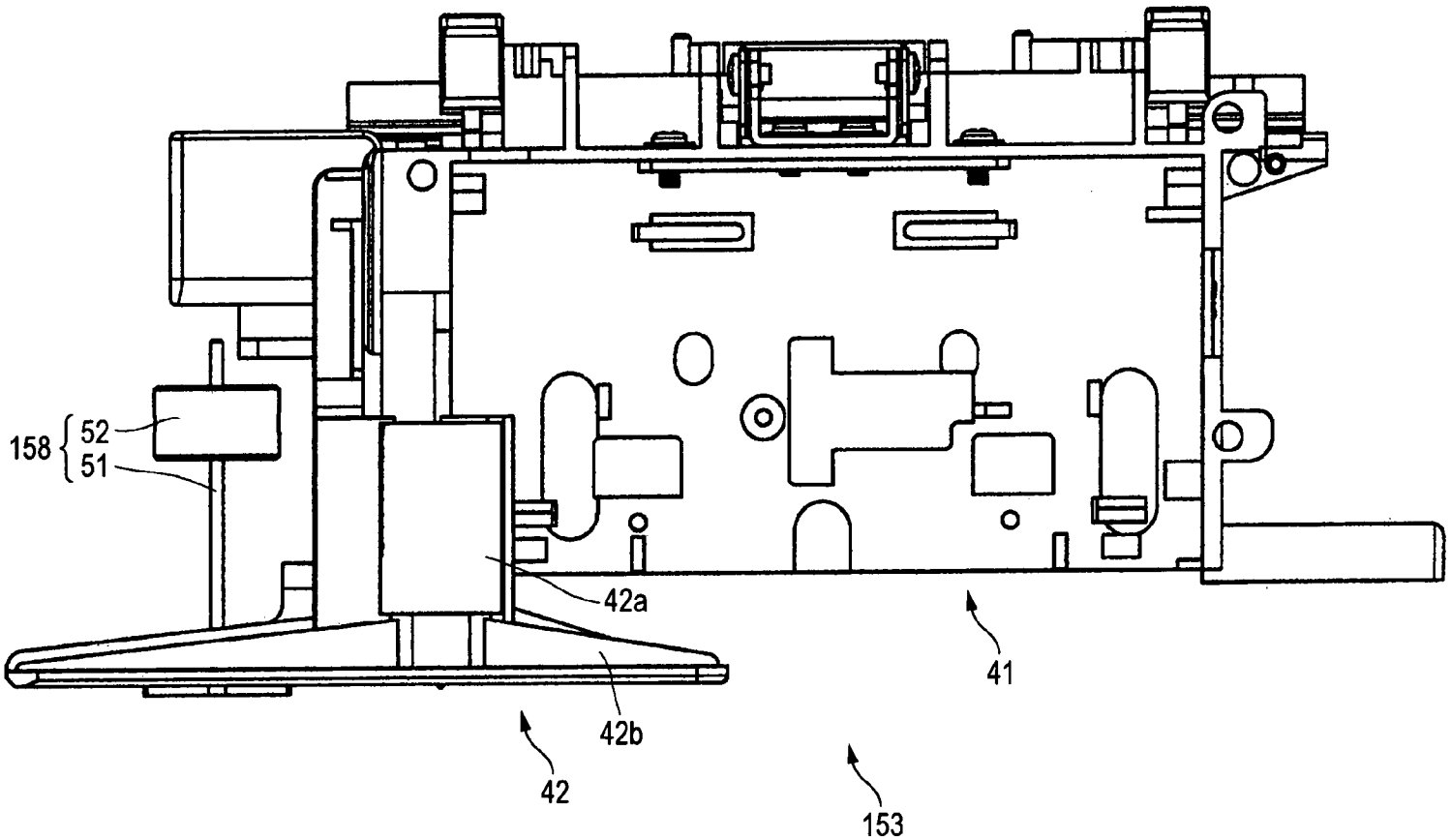
FIG. 11 is a plan view of the carriage in FIG. 10.

FIG. 10 is a perspective view showing the details of a carriage 153 according to a fourth embodiment of the invention, and FIG. 11 is a plan view of its carriage 153. This carriage 153 comprises a connection part 41 which is connected to a belt 156, an attachment part 42 to which a cutter 154 and a vibration absorbing unit 158 are attached, and a not-shown mount part on which a recording head 152 is mounted. The connection part 41 has on its back surface a clamp part 41*a* in which the belt 156 is held. This clamp part 41*a* and the belt 156 are connected.

The attachment part 42 is integrally attached to one end of the connection part 41 by a screw, a fixed portion 42*a* to which the cutter 154 is fixed is formed at the lower portion of the attachment part 42, and a fixed portion 42*b* to which the vibration absorbing unit 158 is fixed is formed at the lower portion of this fixed portion 42*a*. Further, the cutter 154 is inserted into the fixed portion 42*a* and attached thereto, and the vibration absorbing unit 158 is placed on the fixed portion 42*b* and attached thereto. In the bottom surface of the mount part, a hole to which a nozzle forming surface of the recording head 152 is exposed is formed, the recording head 152 is mounted to this hole, and a damper or the like is further mounted thereon.

The vibration absorbing unit 158 comprises a bar member 51 and a dead-weight member 52. The bar member 51 is arranged so as to face in the nearly perpendicular direction, has a free end at the upper end and a fixed end at the lower end, is flange-shaped, and fixed onto the fixed portion 42*b* of the attachment part 42 by a screw 51*a*. Therefore, in the bar member 51, the lower end works as a supporting point, and the upper end can oscillate. The dead-weight member 52 is formed cylindrically, and in the center of the dead-weight member 52, a through-hole 52*a* into which the bar member 51 can be inserted is formed. Further, on the peripheral surface of the dead-weight member 52, a threaded hole 52*b* communicating with the hole 52*a* is formed, and a screw 52*c* coming into contact with the peripheral surface of the bar member 51 is engaged into this threaded hole 52*b*. Therefore, the dead-weight member 52 is attachable to an arbitrary position of the bar member 51.

Here, a case in which forced vibration $P_0 \cos \omega t$ produced by cogging of a carriage motor and represented by the before-mentioned expression (1) is applied to the carriage 153 will be thought. Herein, $P_0$ is level of the forced vibration, $\omega$ is frequency of the forced vibration, t is time, m is mass of the carriage 153, a is acceleration of the carriage 153 in the moving time, k is spring constant of the carriage 153, and x is displacement of the carriage 153.

$$P_0 \cos \omega t = ma + kx \quad (1)$$

Therefore, natural frequency p of the carriage 153 is represented by the following expression (2):

$$p = \sqrt{(k/m)} \quad (2)$$

On the other hand, oscillation of the vibration absorbing unit 158 is represented by the following expression (3) on the basis of Hooke's law:

$$m_0 g = k_0 x_0 \quad (3),$$

wherein $m_0$ is mass of the dead-weight member 52 in the vibration absorbing unit 158, $k_0$ is spring constant of the bar member 51 up to the dead-weight member 52 in the vibration absorbing unit 158, and $x_0$ is displacement (oscillation width) of the dead-weight member 52 in the vibration absorbing unit 158.

Therefore, natural frequency $p_0$ of the vibration absorbing unit 158 is represented by the following expression (4):

$$p_0 = \sqrt{(k_0/m_0)} = \sqrt{(g/x_0)} \quad (4)$$

Therefore, by changing the fixed position of the dead-weight member 52 in the bar member 51 thereby to adjust the displacement (oscillation width) $x_0$ of the dead-weight member 52, and setting the natural frequency of the carriage 153, $p=\sqrt{(k/m)}$ so as to become equal to the natural frequency of the vibration absorbing unit 158, $P_0=\sqrt{(k_0/m_0)}=\sqrt{(g/x_0)}$, the forced vibration $P_0 \cos \omega t$ produced by cogging of the carriage motor is canceled by the oscillation of the vibration absorbing unit 158. Therefore, the recording head 152 mounted on the mount part 31 of the carriage 153, without receiving the influence by the forced vibration $P_0 \cos \omega t$ produced by cogging of the carriage motor, can obtain a good recording result.

As described above, according to the carriage 153 in the fourth embodiment, since it has the vibration absorbing unit 158 which can be adjusted so as to absorb the vibration produced in the moving time, the adjustment to the vibration in the moving time of the carriage 153 can be performed on the vibration absorbing unit 158 side, and the above vibration can be sufficiently removed over a long term, so that recording accuracy of the recording head 152 can be kept in a high state. Further, the vibration absorbing unit 158 changes the oscillation width in oscillation caused by the above vibration according to the frequency of the above vibration thereby to absorb the vibration. Therefore, since the user should adjust only the oscillation width of the vibration absorbing unit 158, the adjusting work becomes easy. Further, in the above embodiment, though the vibration absorbing unit 158 is attached to the attachment part 42, the invention is not limited to this. Even if the vibration absorbing unit 158 is attached in an arbitrary position or in an arbitrary direction on the carriage 153, the similar effect is obtained.

Figure 12:
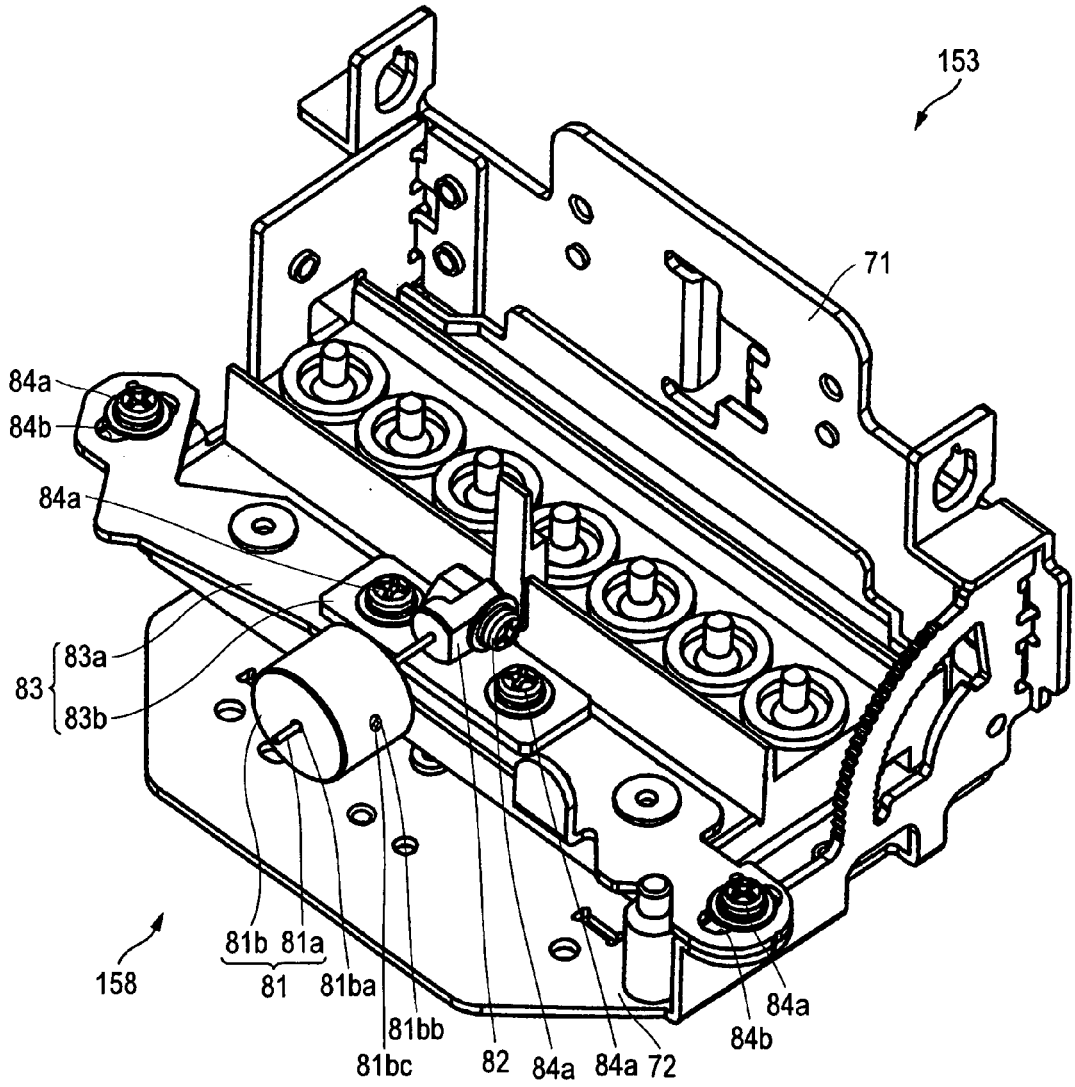
FIG. 12 is a perspective view showing details of another example of the carriage of the printer in FIG. 1, which shows the characteristic portion of the invention.
Figure 13:
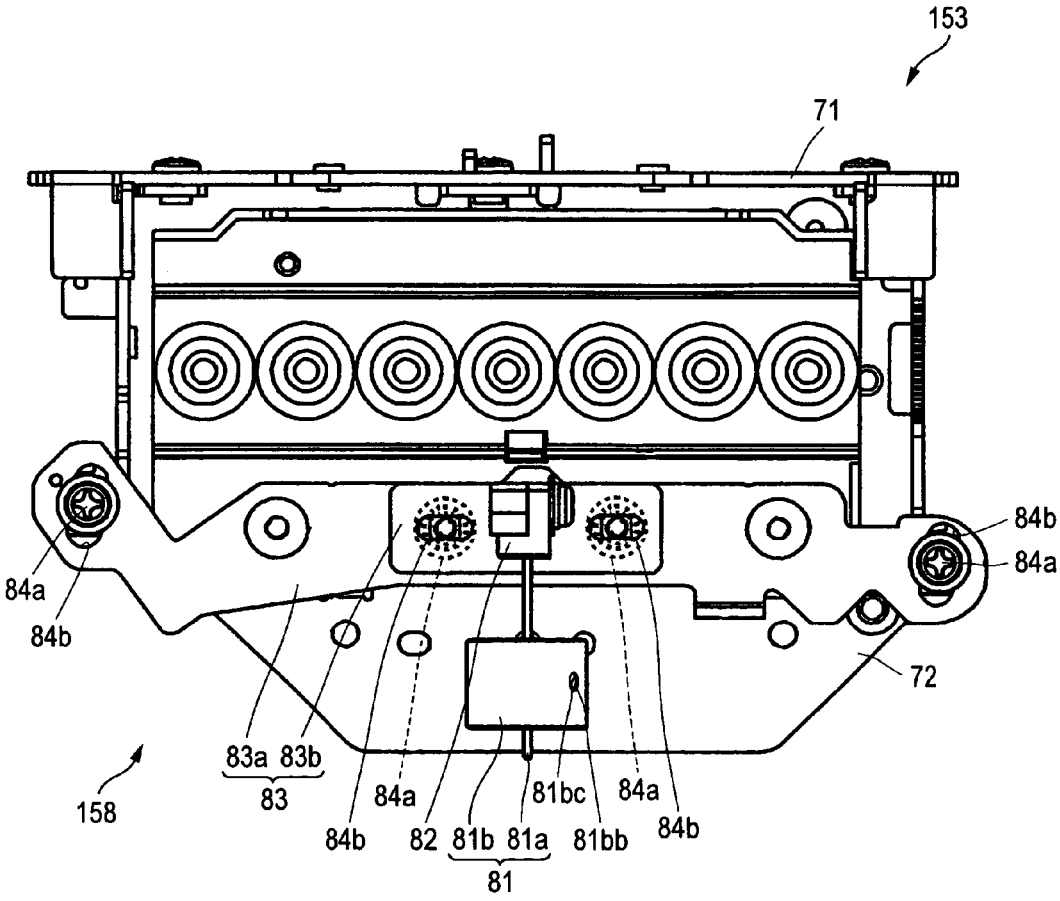
FIG. 13 is a plan view of the carriage in FIG. 12.

FIG. 12 is a perspective view showing the details of a carriage 153 according to a fifth embodiment of the invention, and FIG. 13 is a plan view of its carriage 153. This carriage 153 comprises a connection part 71 connected to a belt 156, a mount part 72 on which a recording head 152 is mounted, and a vibration absorbing unit 158 which isolates vibration from the carriage 153. The connection part 71 has on its back surface a not-shown clamp part in which the belt 156 is held, and this clamp part and the belt 156 are connected.

In the bottom surface of the mount part 72, a not-shown hole to which a nozzle forming surface of the recording head 152 is exposed is formed, the recording head 152 is mounted to this hole, and a damper or the like is further mounted thereon. The vibration absorbing unit 158 comprises a vibration absorbing part 81 which absorbs vibration, an angle position adjusting part 82 which adjusts an angle position of this vibration absorbing part, and an installation adjusting part 83 which adjusts an installation position of the vibration absorbing part 81.

The vibration absorbing part 81 comprises a bar member 81*a* and a dead-weight member 81*b*. The bar member 81*a* has a free end at one end and a fixed end at the other end, and is fixed onto the angle position regulating part 82. The dead-weight member 81*b* is formed cylindrically, and in the center of the dead-weight member 81*b*, a through-hole 81*ba* into which the bar member 81*a* can be inserted is formed. Further, on the peripheral surface of the dead-weight member 81*b*, a threaded hole 81*bb* communicating with the hole 81*ba* is formed, and a screw 81*bc* coming into contact with the peripheral surface of the bar member 81 is engaged into this threaded hole 81*bb*. Therefore, the dead-weight member 81*b* is attachable to an arbitrary position of the bar member 81*a*.

The angle position adjusting part 82 is formed nearly cylindrically, has one end surface to which the other end of the bar member 81*a* of the vibration absorbing part 81 is fixed, and a side surface to which a screw 84*a* is attached; and is attached to a second adjusting plate 83*b* of the installation adjusting part 83, which will be described later. This angle position adjusting part 82, together with the vibration absorbing portion 81, can rotate about a potion of the screw 84*a* attached in the main scanning direction, toward the sub-scanning direction from a nearly horizontal state to a nearly perpendicular state. Therefore, the angle position adjusting part 82 can adjust the angle position of the vibration absorbing part 81, that is, the position of the vibration absorbing part 81 in the perpendicular direction (Z-direction) to the main scanning direction and the sub-scanning direction. Further, the vibration absorbing part 81 may be constituted so that it can rotate freely in multi-directions by, for example, a universal joint.

The installation adjusting part 83 comprises a first strip-shaped adjusting plate 83*a* which has the length of the nearly same size as size of the width of the mount part 72, and a second strip-shaped adjusting plate 83*b* which is shorter in length than the first adjusting plate 83*a*. The first adjusting plate 83*a* is attached at its both ends onto the mount part 72 by two screws 84*a*. Threaded holes 84*b* formed at both ends of the first adjusting plate 83*a* are formed into long holes extending in the sub-scanning direction, and can position the first adjusting plate 83*a* in an arbitrary position in the sub-scanning direction.

The second adjusting plate 83*b* is attached at its both ends onto the nearly central portion of the first adjusting plate 83*a* by two screws 84*a*. Threaded holes 84*b* formed at both ends of the second adjusting plate 83*b* are formed into long holes extending in the main scanning direction, and can position the second adjusting plate 83*b* in an arbitrary position in the main scanning direction. Therefore, the installation adjusting part 83 can adjust arbitrarily the installation position of the vibration absorbing part 81, that is, the positions of the vibration absorbing part 81 in the main scanning direction (X-direction) and in the sub-scanning direction (Y-direction).

According to the vibration absorbing unit 158 thus constructed, the angle position adjusting part 82 adjusts the angle position of the vibration absorbing part 81, whereby components of vibration in all the directions can be absorbed. Further, the installation adjusting part 83 adjusts the installation position of the vibration absorbing part 81, whereby the vibration absorbing range can be determined. Further, the fixed position of the dead-weight member 81*b* of the vibration absorbing part 81 is changed and the oscillation width of the bar member 81*a* is adjusted according to the frequency of the vibration, whereby the vibration can be absorbed.

As described above, according to the carriage 153 in the fifth embodiment, since it has the vibration absorbing unit 158 which can be adjusted so as to absorb the vibration produced in the moving time, the adjustment to the vibration in the moving time of the carriage 153 can be performed on the vibration absorbing unit 158 side, and the above vibration can be sufficiently removed over a long term, so that recording accuracy of the recording head 152 can be kept in a high state. Namely, since the angle position of the vibration absorbing part 81 is adjusted by the angle position adjusting part 82 to absorb the components of vibration in all the directions, even if the vibration produced in the carriage 153 has any form, the vibration can be sufficiently removed and recording accuracy of the recording head can be kept in a high state. Further, since the installation position of the vibration absorbing part 81 is adjusted by the installation adjusting part 83 to determine the vibration absorbing range, the vibro-isolating effect can be heightened more.

In each of the above-mentioned embodiments, as an example of the recording apparatus, the ink jet printer has been described. However, the invention is not limited to this but the invention can be also applied to, for example, a facsimile apparatus or a copying machine as long as its recording apparatus includes a carriage. Further, the invention is not limited to the recording apparatus but can be also applied to a liquid ejection apparatus which ejects liquid corresponding to its use in place of ink from a liquid ejection head to an ejected medium thereby to attach the liquid onto the ejected medium. As the liquid ejection apparatuses, there are, for example, an apparatus having a color material ejection head used in manufacture of a color filter of a liquid crystal display, an apparatus having an electrode material (electro-conductive paste) ejection head used in formation of electrodes of an organic EL display or a surface-emitting display (FED), an apparatus having a bioorganism ejection head used in manufacture of a biochip, and an apparatus having a sample ejection head as a precise pipette.

What is claimed is:

1. A carriage, on which a recording head is mounted, to which a moving unit is connected, and which reciprocates a recording area by said moving unit to perform recording by said recording head, wherein a mount part of said recording head and a connection part to said moving unit are separately provided and said mount part and said connection part are coupled by a coupling structure having elasticity;

wherein said coupling structure has a linear elastic member; and said coupling structure has a regulating member for regulating a displacement of said linear elastic member.

2. The carriage according to claim 1, wherein a gap is provided between said linear elastic member and said regulating member.

3. The carriage according to claim 1, wherein said linear elastic member includes a plate spring.

4. The carriage according to claim 1, wherein said linear elastic member includes a coil spring.

5. A recording apparatus, which performs recording on a recording medium, including the carriage according to claim 1.

6. A liquid ejection apparatus, which ejects liquid onto an ejected medium, including the carriage according to claim 1.

7. A carriage, on which a recording head is mounted, to which a moving unit is connected, and which reciprocates a recording area by said moving unit to perform recording by said recording head, wherein a mount part of said recording head and a connection part to said moving unit are separately provided and said mount part and said connection part are coupled by a coupling structure having elasticity;

wherein said coupling structure has non-linear elasticity; and wherein said coupling structure changes the elasticity thereof corresponding to a level of vibration produced in movement of the carriage.

8. The carriage according to claim 7, wherein said coupling structure includes a spring member.

9. A carriage, on which a recording head is mounted, to which a moving unit is connected, and which reciprocates a recording area by said moving unit to perform recording by said recording head, wherein a mount part of said recording head and a connection part to said moving unit are separately provided and said mount part and said connection part are coupled by a coupling structure having elasticity wherein said coupling structure has non-linear elasticity; and wherein said coupling structure has a linear elastic member having linear elasticity and a regulating member for regulating a displacement of said linear elastic member.

10. The carriage according to claim 9, a gap is provided between said linear elastic member and said regulating member.

11. The carriage according to claim 9, wherein said linear elastic member includes a plate spring.

12. The carriage according to claim 9, wherein said linear elastic member includes a coil spring.

* * * * *